United States Patent [19]

Piltz

[11] Patent Number: 4,961,511

[45] Date of Patent: Oct. 9, 1990

[54] END CLOSURE FOR A PACKAGING CONTAINER

[75] Inventor: Lars-Erik Piltz, Dalby, Sweden

[73] Assignee: AB Akerlund & Rausing, Sweden

[21] Appl. No.: 309,250

[22] Filed: Feb. 10, 1989

[30] Foreign Application Priority Data

Feb. 16, 1988 [SE] Sweden ..... 8800516

[51] Int. Cl.[5] ..... B65D 17/34

[52] U.S. Cl. ..... 220/270

[58] Field of Search ..... 220/270, 257

[56] References Cited

U.S. PATENT DOCUMENTS

| | | | |
|---|---|---|---|
| 3,338,199 | 8/1967 | Taylor | 220/270 X |
| 3,499,572 | 3/1970 | Ruekberg | 220/270 |
| 3,650,387 | 3/1972 | Hornsby et al. . | |
| 4,784,284 | 11/1988 | Miyauchi et al. | 220/270 |
| 4,830,214 | 5/1989 | Curliss et al. | 220/270 |

FOREIGN PATENT DOCUMENTS

| | | |
|---|---|---|
| 194351 | 2/1965 | Sweden . |
| 8306089-7 | 3/1986 | Sweden . |

*Primary Examiner*—Donald F. Norton

*Attorney, Agent, or Firm*—Lerner, David, Littenberg, Krumholz & Mentlik

[57] ABSTRACT

A closure or closure element manufactured by injection moulding and provided with an easy opening device having a pull-ring and a tearing strip emerging therefrom.

The tearing strip forms and defines a region which is concave. A recess is arranged cross-wise in a major part of an inlet to the concave region. The recess can be formed by the injected molten material having been diverted and delayed when entering the concave region. The delay enables the concave region and the portion of the tearing strip defining it to be formed substantially simultaneously. The orientation of the material at the junction of the tearing strip and the concave region is also diverted.

5 Claims, 1 Drawing Sheet

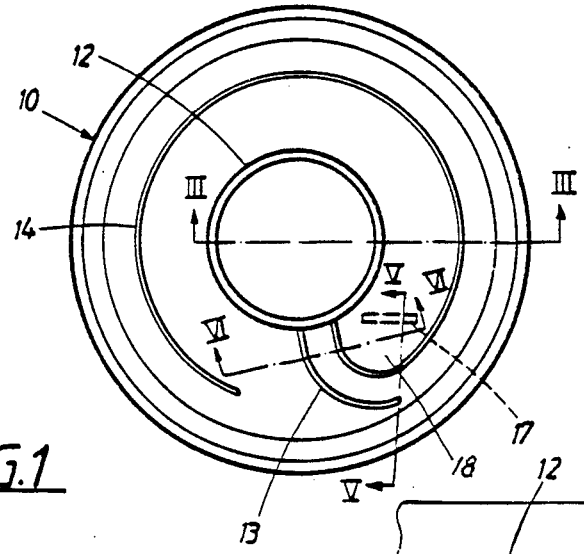
FIG.1
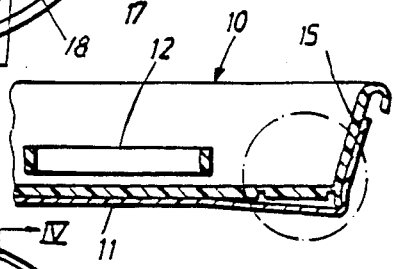
FIG.3
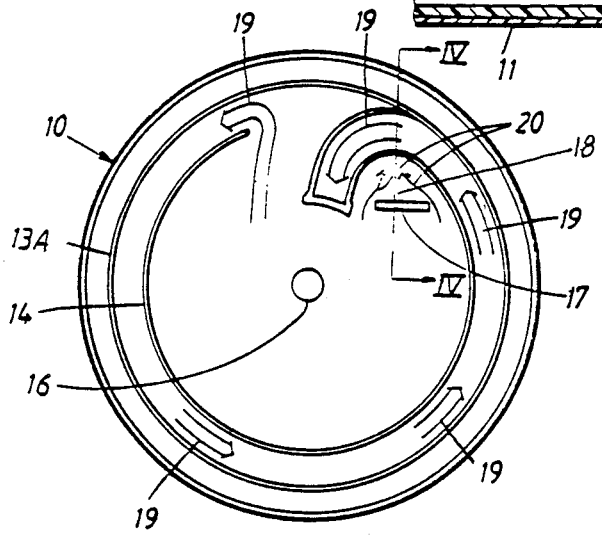
FIG.2
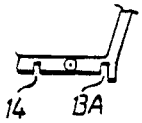
FIG.4
FIG.5
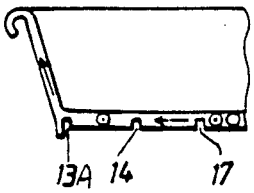
FIG.6
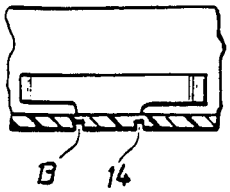

END CLOSURE FOR A PACKAGING CONTAINER

FIELD OF THE INVENTION

The present invention relates to an end closure for a package or packaging container.

BACKGROUND OF THE INVENTION

Single ingot techniques may be used to form packaging containers. The term "ingot" is used to identify the area of a mold in which material flows to form a product, in this case, a closure. The term "ingot" also identifies the protrusion or excess material, sometimes referred to as "flashing", which results from the use of an ingot technique. Thus, in a single ingot technique, a single ingot would be presented on the product yielded thereby. However, when using a single ingot technique, very thin material layers are involved. Specifically, wall thicknesses of the container end closure materials formed thereby have a maximum of a few millimeters and a minimum on the order of tenths of millimeters. For the user's convenience, it is advantageous to form an easy-opening device having a grip and a tearing strip as part of the packaging end closure. However, when so doing it is important that the grip, which desirably merges into the tearing strip, be strongly bound thereto but also be easily, completely and cleanly removable when desired. Unfortunately, present techniques and present closure configurations have forced a trade-off between strength and ease of opening.

OBJECTS OF THE INVENTION

An object of the present invention is to provide for a one-step, single ingot injection moulding procedure to produce a relatively complex end closure.

Another object of the present invention is to provide an end closure for a package or packaging container which is sufficiently strong to protect the contents contained therein but which is easily, completely and cleanly torn away when the grip of a tearing strip provided therein is grasped and pulled.

It is also an object of the present invention to provide a procedure for producing an end closure for a packaging container which has an improved material orientation which results from a unique material flow pattern providing superior characteristics and the enclosure produced thereby.

SUMMARY OF THE INVENTION

The present invention provides an end closure for a packaging container comprising at least an outer layer formed from injection molded material having an easy opening device arranged therein including a grip, a circumferential tearing denotation inwardly adjacent a rim defining a periphery of said outer layer, a first tearing denotation extending from said grip to said circumferential tearing denotation, a second tearing denotation spaced from said first tearing denotation and spaced inwardly of said circumferential tearing denotation and extending from said grip, said first tearing denotation, said second tearing denotation and said circumferential tearing denotation defining a tearing strip, said tearing strip defining a concave region or area adjacent said grip, and a recess arranged crosswise in a major part of an inlet to said concave area, said recess having been formed as a result of the flow of said injection molded material into said concave region being diverted.

The device is characterized in that the outer layer is a layer of injection moulded material which has been injection moulded by one single ingot. The ingot is placed centrally, through an apperature in a mold, relative the periphery of the outer layer.

The mold is also so constructed such that it will form a plurality of tearing denotation which, acting in concert, define a tearing strip. The tearing strip defines a concave area or region between the grip and the portion of the tearing strip defined by the second tearing denotation. There is also a recess arranged in the concave region or area which, in the finished packaging container closure is preferably in the shape of a generally linear recess in the lower side of the outer layer, the wall thickness in the area of recess having a reduced thickness relative to the thickness of the outer layer. The recess is arranged crosswise in a major part of the inlet to the concave area. The recess can be formed by diverting the molten injection molded material from the area in which it is to be arranged. This has the effect of both re-orienting the flow of the material passing by the recess into the concave area relative to the direction of the flow of material forming the tearing strip, and slowing down the formation of the concave region such that its formation occurs substantially simultaneously with the formation of the tearing strip immediately adjacent the concave area.

In one embodiment the end closure is of the type which is penetrated in two steps, one first step providing breaking up of an outer layer of the closure, and a second step where an inner layer is broken through.

In a preferred embodiment the grip comprises a centrally placed ring and the tearing denotations start out from the ring in the shape of two generally parallel grooves defining a tearing strip, and forming the concave area while extending outwardly towards a rim extending circumferentially around the end closure.

In order to achieve an optimum effect, the concave region or area for slowing down the flow of material is so dimensioned such that, seen in the material flow direction, the area behind the recess is filled up with injection moulded material generally simultaneously with the filling up of the area between the two parallel grooves or tearing denotations by a generally circumferential flow of material.

In one embodiment the slowing down area is formed as a generally linear recess in the lower side of the outer layer.

In order to be able to use the conventional so called membrane welding technique, by using an external support and an inner circumferential welding jaw, and ensure that a weldable inner layer is not welded across one or several of the tearing denotations, the rim of the end closure, in a preferred embodiment, has been provided with an extended ledge or extension which is oriented in a direction towards the interior of the packaging container when a container is sealed with the closure of the present invention. This extension maintains an inner layer unwelded to the outer layer along the tearing denotations.

In a specific embodiment the end closure is generally circular and also the tearing denotations define generally circular path in the outer layer.

In order to obtain a so called "full panel"-opening one of said parallel tearing denotations is placed close to the rim.

BRIEF DESCRIPTION OF THE DRAWINGS

Preferred embodiments of the present invention will be described in greater detail with reference to the accompanying drawings wherein like members bear like reference numerals and wherein:

FIG. 1 is a view from above of a cover or end closure according to the present invention, FIG. 2 is a view from below of the cover, FIG. 3 is a cut along the arrow III—III in FIG. 1, FIG. 4 shows the flow of material in a strip-shaped circumferential part of the cover panel, corresponding to the one encircled in FIG. 3, FIG. 5 is a section along the arrow V—V in FIG. 1, FIG. 6 is a section along the arrow VI—VI in FIG. 1.

DETAILED DESCRIPTION OF THE PREFERRED EMBODIMENTS

The end closure 10 shown in Figs. 1 and 2 is a closure which alone may be used for forming an enclosure of a container, or the closure or element 10 may form an outer layer arranged on the top of an inner layer 11 according to FIG. 3, FIG. 3 should be interpreted such that the element 10 in FIGS. 1 and 2 does not necessarily have an inner layer 11, in spite of the fact that the section line III—III denotes a section through the element 10.

In the case where the end closure has both inner and outer layers, the arrangement is of the so called two-step closure type mentioned at the introduction, where firstly by means of an easy opening device comprising a pull-ring 12 and a pair of parallel tearing denotations, a circumferential tearing denotation 13*a*, and a second tearing denotation 14 the element 10 is penetrated, such that there only remains a rim 15 of the element which defines a periphery of the end closure, and which rim in a mounted position is attached to the inner wall of a container opening or possibly to a pipe shaped connection piece of a container. After the outer element has been removed the inner layer 11 is to be punctured, preferably along the edge of the rim in order to provide a so called "full panel"-opening.

According to the present invention the element 10 is injection moulded of plastics, for instance polypropylene or other suitable material, and the injection moulding technique is such that only one single ingot 16, centrally placed relative the element 10 is used for the manufacture. It should also be noticed that the wall thickness is of absolute minimum, which from a cost point of view is necessarily taking in account the cost of material. As to the configuration of the end closure, element 10 further comprises a complex pattern of grooves having a heavily reduced material thickness forming a plurality of tearing denotations and a member and a circumferential angulate rim. It should be realized that the single ingot manufacturing technique by no means is a technique which could be expected to be useful in the formation of an end closure of the present invention.

To the contrary, prior art suggest the use of methods using multiple ingots in corresponding applications meaning that the prior art discloses a more complex and expensive tool structure.

According to the present invention, very surprisingly, it has been found that a single ingot technique is useful under certain conditions meaning that the construction of the present end closure allows for the use of a single ingot technique.

As appears from FIG. 2, the ingot 16 is placed centrally relative the lower side of the finished element 10. The recess 17 is specifically arranged such that the recess-forming member on the mold generally blocks the inlet to a concave region or area 18, seen in the direction from the ingot 16, which concave area is terminated by the reduced wall thickness material of the second tearing denotation 14. There is obtained thereby an efficient guiding of the main flow of the material in the direction of the heavy arrows 19 in FIG. 2. This means that the material orientation at the "bottom" of the concave area 18 and the area of the tearing strip adjacent to and defining the concave region will be generally tangential. circumferentially along the tearing denotation 14. This is illustrated also in FIG. 4.

Having in mind that exactly the bottom is the critical point at the tearing up procedure, the flow of material shown provides a substantially lower tearing force in the actual area, and therefor a safe tearing up without breakage.

The recess 17 should be dimensioned such that when the flow of material according to the arrows 19 has been filled up to a substantial degree, the strip defined by the tearing denotations 13 and 14 fills up the concave area 18 at the same time as the heavily reduced flow of material on the direction of the arrows 20. By so dimensioning the recess 17, an easy tearing up region is provided exactly in the critical area, that is, the concave area 18, as shown in FIG. 2.

In FIG. 5 there is shown the flow of material at both sides of the tearing denotations 13, 14 and the recess 17, with the circles with the dots in the center representing flow in a direction "out" of the page, circle with no center dot representing a flow 'into' the page.

We claim:

1. An end closure for a packaging container comprising at least an outer formed from injection molded material having an easy opening device arranged therein including a grip, a circumferential tearing denotation inwardly adjacent a rim defining a periphery of said outer layer, a first tearing denotation extending from said grip to said circumferential tearing denotation a second tearing denotation spaced from said first tearing denotation and spaced inwardly of said circumferential tearing denotation and extending from said grip, said first tearing denotation, said second tearing denotation and said circumferential tearing denotation defining a tearing strip, said tearing strip defining a concave region adjacent said grip, and a recess arranged cross-wise in a major part of an inlet to said concave area.

2. The end closure of claim 1, wherein an area of said tearing strip adjacent to and defining said concave region and said concave region have been formed substantially simultaneously.

3. The end closure of claim 1, wherein the wall thickness in the area of said recess is less than the remaining thickness of the outer layer.

4. The end closure of claim 1, further comprising an inner layer adjacent a first side of said outer layer, said inner layer having a circumference greater than that of said circumferential tearing denotation.

5. The end closure of claim 4, wherein said inner layer and said outer layer are attached so as to provide a seal for said end closure.

* * * * *